US006681406B2

(12) United States Patent
Yang

(10) Patent No.: US 6,681,406 B2
(45) Date of Patent: Jan. 27, 2004

(54) EXTENDIBLE BELT

(75) Inventor: Jong H. Yang, Concord, MA (US)

(73) Assignee: The Timberland Company, Stratham, NH (US)

( * ) Notice: Subject to any disclaimer, the term of this patent is extended or adjusted under 35 U.S.C. 154(b) by 157 days.

(21) Appl. No.: 10/051,638

(22) Filed: Jan. 18, 2002

(65) Prior Publication Data

US 2003/0135913 A1 Jul. 24, 2003

(51) Int. Cl.[7] ..... A41F 3/02
(52) U.S. Cl. ..... 2/338; 2/311; 128/101.1
(58) Field of Search ..... 2/338, 300, 310–323, 2/80, 83, 76, 221, 229, 237, 920, 44–45, 94, 339; 128/95.1, 99.1, 100.1, 869, 101.1

(56) References Cited

U.S. PATENT DOCUMENTS 2,185,834 A * 1/1940 Creper ..... 450/134
2,911,653 A * 11/1959 O'Donnell ..... 2/321
3,001,202 A * 6/1961 Serrano ..... 2/102
3,908,875 A 9/1975 Wilson et al.
4,095,415 A 6/1978 Bower
4,757,926 A 7/1988 Leo
5,054,433 A 10/1991 Pfleger
5,398,385 A 3/1995 Plut
5,403,271 A 4/1995 Saunders et al.
5,566,397 A 10/1996 Scott
5,623,750 A 4/1997 Nasin et al.
5,776,087 A 7/1998 Nelson et al.
5,823,409 A 10/1998 Kennedy
6,108,821 A 8/2000 Masoute
6,449,775 B1 * 9/2002 Battaglia ..... 2/312

* cited by examiner

*Primary Examiner*—Tejash Patel
(74) *Attorney, Agent, or Firm*—Ropes & Gray

(57) ABSTRACT

A garment belt including an extendible insert. The insert may flex or stretch while the belt is being worn so that the belt adapts to variations in a wearer's waist size and shape.

8 Claims, 3 Drawing Sheets

EXTENDIBLE BELT

BACKGROUND OF THE INVENTION

Garment belts typically include a buckle for adjusting length of the belt to a wearer's waist size. The buckle may provide a number of discrete positions for fastening the belt or may include a mechanism for adjustment along a continuous length of the belt. In any case, the length of the belt is fixed once the belt is placed about a wearer's waist and the buckle is fastened. As a significant disadvantage, fixed-length belts such as these will not adapt to changes in a user's waistline, which may occur when a user is active, when a user changes from a standing to a sitting position, or simply when a user eats an ample meal.

One approach to this problem is to fashion a belt from a pliable material that can extend during use, such as rubber or certain woven strapping materials. However, this approach cannot accommodate the use of familiar and aesthetically pleasing materials, such as finished leather, for a belt.

There remains a need for a belt fashioned from a non-extendible material that can adapt to variations in a wearer's waistline while in use.

SUMMARY OF THE INVENTION

A garment belt includes an extendible insert. The insert may flex or stretch while the belt is being worn so that the belt adapts to variations in a wearer's waist size and shape.

BRIEF DESCRIPTION OF DRAWINGS

The foregoing and other objects and advantages of the invention will be appreciated more fully from the following further description thereof, with reference to the accompanying drawings, wherein.

DETAILED DESCRIPTION OF THE PREFERRED EMBODIMENT(S)

To provide an overall understanding of the invention, certain illustrative embodiments will now be described, including a leather belt with a rubber insert stitched along the length thereof. However, it will be understood that the systems and methods described herein may be usefully applied to any garment belt or other belt where a range of extendibility is desired for an otherwise non-extendible belt material. All such belts are intended to fall within the scope of the systems described herein.

Figure 1:
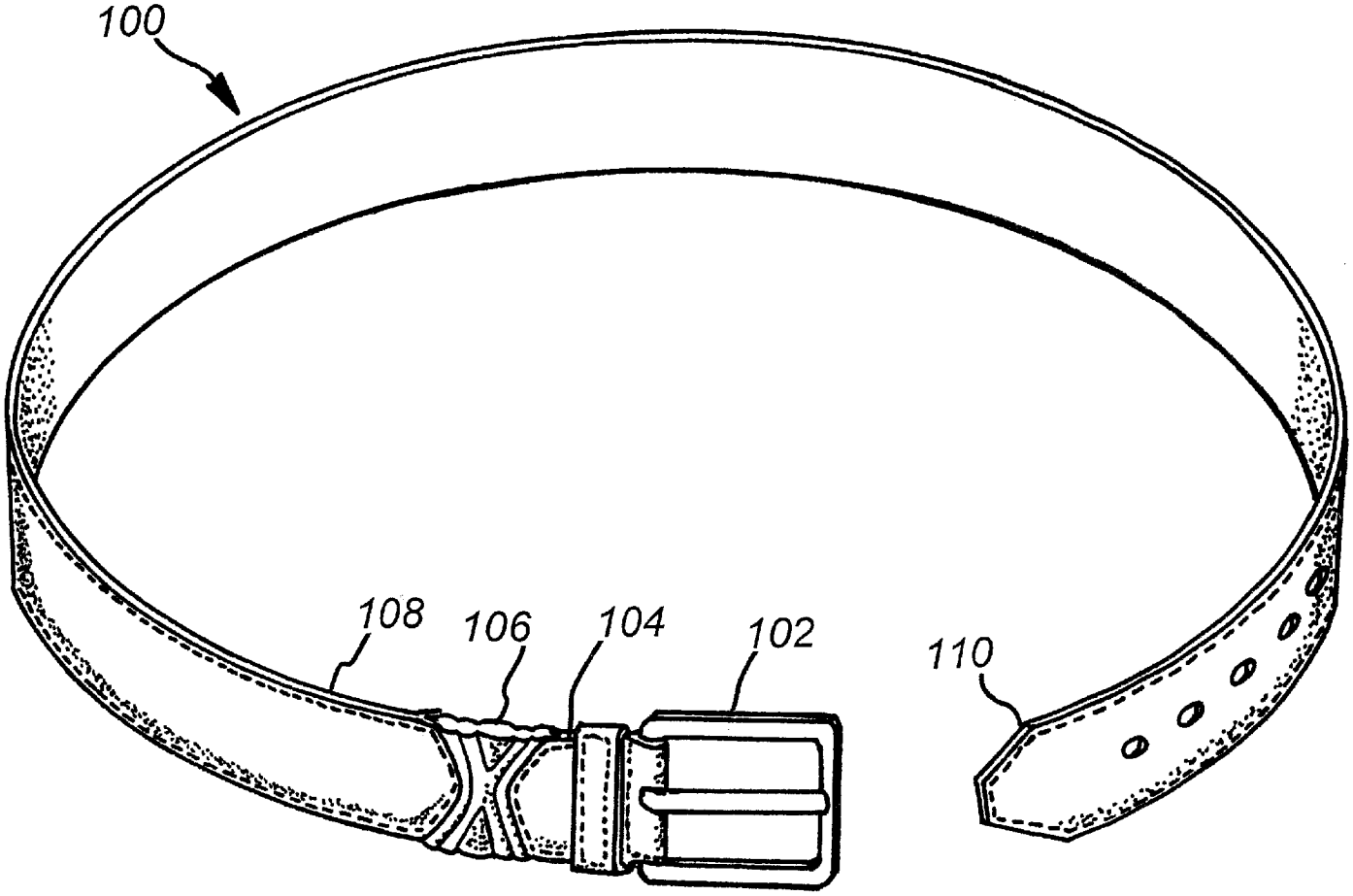
FIG. 1 shows a belt including an extendible insert.

FIG. 1 shows a belt including an extendible insert. A belt 100 may include a buckle 102, a first length of non-extendible material 104, an extendible insert 106, and a second length of non-extendible material 108 having a free end 110 adapted to be fastened by the buckle 102.

The buckle 102 and the free end 110 may be of any conventional manufacture for securing a belt, and may include snaps, clasps, pins, sliders, or any other connecting mechanisms. The buckle 102 may be formed of metal, plastic, or any other materials, or combinations thereof, having adequate strength to secure a belt around a waist of a belt wearer. In the depicted embodiment, the buckle 102 is secured through holes in the free end 110 of the belt 100. In another embodiment, the buckle 102 may comprise a loop (not shown), and the free end 110 may include VELCRO, buttons, or some other mechanism for allowing the free end 110 to be threaded through the loop of the buckle 102 and attached to itself in a secure manner.

The non-extendible material 104, 108 may be any material suitable for use in a garment belt, including leather, woven materials including cotton, nylon, or polyester, metal links, braided leather, plastic, cloth, rope, spandex, lycra, suede, and so forth. In one common construction two leather strips are stitched together, with a colored leather on an outside of the belt 100 and an unfinished or uncolored leather on the inside. It will be appreciated that different types of material may be used for the different sections of the non-extendible material 104, 108.

The insert 106 may be of any flexible material, such as rubber, neoprene, or any other material that is elastic and capable of bearing sufficient load for use in a garment belt. The insert 106 may provide a limited range of extendibility, such as one-eighth inch, one-quarter inch, one-half inch, one inch, or some other amount, by which the insert 106 may stretch, thus permitting the waist size of the belt 100, i.e., the inside diameter of a loop formed by the belt 100 when buckled, to expand by a corresponding amount when force is applied thereto. The insert 106 may be formed of a material which will rend, tear, crack, or otherwise yield non-elastically when stretched beyond the limited range of extendibility. This point of yield may be selected to be greater than or less than a yield point for the non-extendible material 104, 108 or the joint between the insert 106 and the non-extendible material 104, 108. The insert 106 may be place near the buckle 102, such as within an inch of the buckle, where it may serve to ornament the front of the belt in addition to providing elasticity, as shown in FIG. 1. However, it will be appreciated that the insert 106 may be interposed anywhere along the length of the belt 100, such as in a middle of a back of the belt (as worn), or on a side of the belt 100. Further, a number of inserts 106 may be interposed along the length of the belt 100, such as one on each side of the belt 100, in order to accommodate additional flexibility, or simply to achieve a desired ornamental effect.

Figure 2:
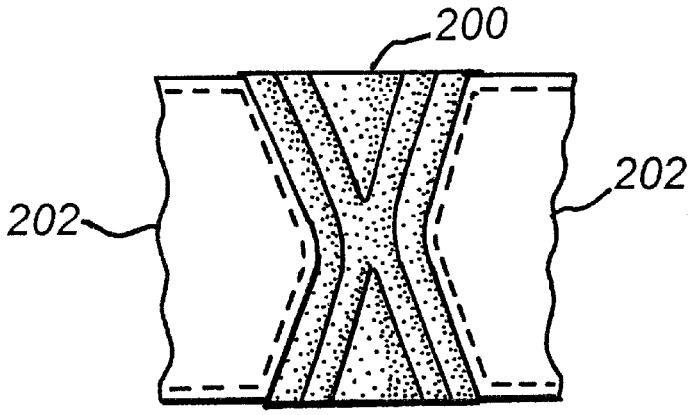
FIG. 2 shows an insert.

FIG. 2 shows an insert. The insert 200 may be, for example, any of the inserts described above in reference to FIG. 1. The insert 200 may be attached to a non-extendible material 202, which may be any of the non-extendible materials described above, by any suitable technique, including stitching or adhesives.

Figure 3:
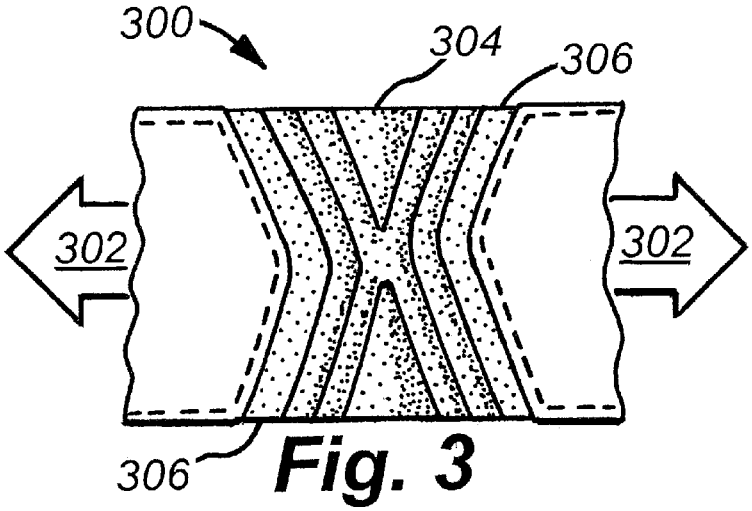
FIG. 3 shows an insert in an extended position.

FIG. 3 shows an insert in an extended position. As indicated generally by outwardly directed arrows 302, the insert 304 may be extended in length along an axis of the belt 300. A comparison of FIG. 2 to FIG. 3 will reveal that, in the depicted embodiment, most of the elastic yielding of the insert 304 occurs at the edges 306 of the insert 304. The insert 304 is thinner in these regions, as illustrated in FIG. 5, and accordingly, where a uniformly elastic material such as rubber is used, will yield more in this region.

Figure 4:
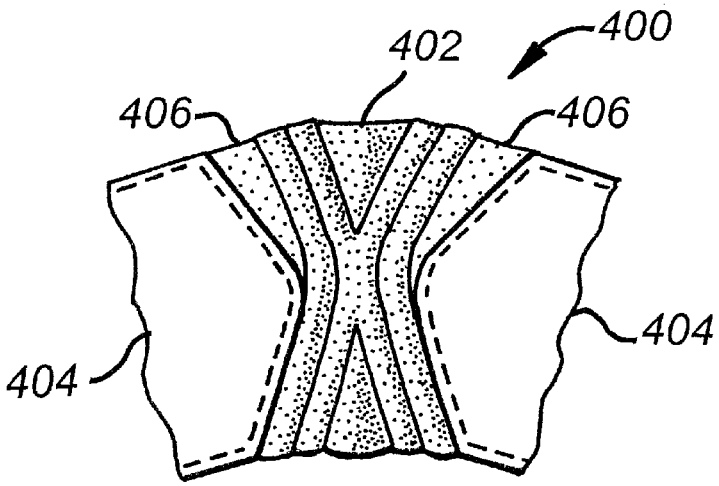
FIG. 4 shows an insert in a pivoted position.

FIG. 4 shows an insert in a pivoted position. The insert 402 may be pivotally attached to the non-extendible material sections 404, such that the insert 402 yields to permit pivoting of the non-extendible material sections 404 relative to one another within a plane of the belt 400. This pivoting motion may be facilitated by an insert that is generally U-shaped or V-shaped on its edges 406, such as the insert 402 of FIG. 4. Other concave shapes (with convex non-extendible material at the seam thereto) may be used to similar affect. Where a stitched seam is used, such as depicted in FIG. 5, along with a rubber insert, the non-extendible material may also slide along the insert/non-extendible material interface to further accommodate pivoting within the plane of the belt.

Figure 5:
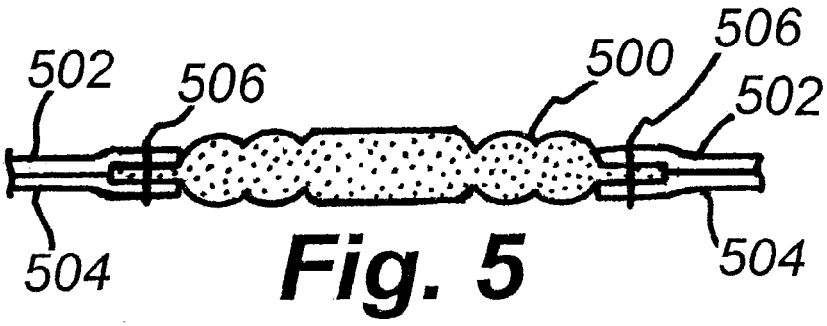
FIG. 5 is a cross-section of an insert attached to a belt.

FIG. 5 is a cross-section of an insert attached to a belt. As depicted, a non-extendible material may have a first ply 502 and a second ply 504, which may be, for example, inside and outside plies of leather in a conventional leather belt assembly. The insert 500 may be placed between the first ply 502 and the second ply 504, and fixed into place using fasteners 506 such as stitched thread, staples, or other fasteners suitable for attaching leather plies and capable of supporting loads placed upon a belt in use by a wearer.

Figure 6:
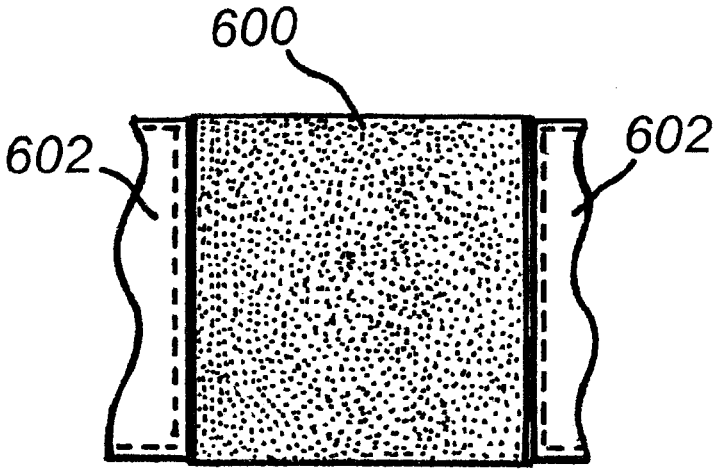
FIG. 6 shows an insert.

FIG. 6 shows an insert. It will be appreciated that an insert as described herein may have any number of different shapes. As one example thereof, the insert 600 of FIG. 6 has straight edges, which may be attached to lengths of non-extendible material 602 using any of the techniques described above.

While the invention has been disclosed in connection with the preferred embodiments shown and described in detail, it will be understood that the invention is not to be limited to the embodiments disclosed herein, but is to be understood from the following claims, which are to be interpreted as broadly as allowed under the law.

What is claimed is:

1. A garment waist belt comprising:

a length of non-extendible material including a first end and a second end;

a buckle connected to the first end of the length of non-extendible material, the buckle being removably attachable to the second end of the length of non-extendible material, thereby joining the length of non-extendible material in a loop; and an insert interposed along the length of non-extendible material, and pivotally attached thereto, wherein the non-extendible material pivots about the insert in a plane of the non-extendible material, the insert further substituting for a portion of the non-extendible material, the insert being elastically extendible, wherein the loop increases in length in response to a force applied along the length of non-extendible material.

2. The belt of claim 1 wherein the non-extendible material includes at least one of leather, metal, or woven strapping.

3. The belt of claim 1 wherein the buckle is metal.

4. The belt of claim 1 wherein the insert extends up to one inch.

5. The belt of claim 1 wherein the insert extends up to one-half inch.

6. The belt of claim 1 further comprising a plurality of inserts.

7. The belt of claim 1 wherein the length of non-extendible material includes a first material attached to a first side of the insert and a second material attached to a second side of the insert.

8. A garment waist belt comprising:

a length of non-extendible material including a first end and a second end;

a buckle connected to the first end of the length of non-extendible material, the buckle being removably attachable to the second end of the length of non-extendible material, thereby joining the length of non-extendible material in a loop; and an insert interposed along the length of non-extendible material and substituting for a portion of the loop, the insert having a first concave region adapted to receive a first convex region of the non-extendible material, and the insert having a second concave region opposite the first concave region and adapted to receive a second convex region of the non-extendible material, the insert being elastically extendible, wherein the loop increases in length in response to a force applied along the length of non-extendible material.

* * * * *